US006953391B1

(12) United States Patent
Majumder et al.

(10) Patent No.: US 6,953,391 B1
(45) Date of Patent: Oct. 11, 2005

(54) METHODS FOR REDUCING SLURRY USAGE IN A LINEAR CHEMICAL MECHANICAL PLANARIZATION SYSTEM

(75) Inventors: Sabir A. Majumder, Fremont, CA (US); Cangshan Xu, Fremont, CA (US); Zhefei Chen, Los Altos, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/901,678

(22) Filed: Jul. 28, 2004

Related U.S. Application Data

(62) Division of application No. 10/113,783, filed on Mar. 30, 2002, now abandoned.

(51) Int. Cl.[7] ..... B24B 1/00
(52) U.S. Cl. ..... 451/60; 451/446; 451/36
(58) Field of Search ..... 451/60, 36, 41, 451/446, 447

(56) References Cited

U.S. PATENT DOCUMENTS

| | | | | |
|---|---|---|---|---|
| 5,997,392 | A * | 12/1999 | Chamberlin et al. | 451/446 |
| 6,284,092 | B1 * | 9/2001 | Manfredi | 156/345.12 |
| 6,589,872 | B1 * | 7/2003 | Twu et al. | 438/692 |
| 6,722,943 | B2 * | 4/2004 | Joslyn | 451/5 |
| 2002/0022440 | A1 * | 2/2002 | Kunugi | 451/60 |
| 2002/0065022 | A1 * | 5/2002 | Iwasaki et al. | 451/35 |

* cited by examiner

*Primary Examiner*—Dung Van Nguyen
(74) *Attorney, Agent, or Firm*—Martine Penilla & Gencarella, L.L.P.

(57) ABSTRACT

Methods for dispensing slurry in a linear chemical mechanical planarization (CMP) system are provided. One method involves the use of a pulsing flow of slurry instead of a continuous flow of slurry. Another method involves spraying a mist of slurry onto the polishing pad. Yet another method involves controlling the gap between the nozzles from which the slurry is dispensed and the top surface of the polishing pad. Each of these methods reduces the amount of slurry used during a CMP operation.

10 Claims, 2 Drawing Sheets

METHODS FOR REDUCING SLURRY USAGE IN A LINEAR CHEMICAL MECHANICAL PLANARIZATION SYSTEM

CROSS REFERENCE TO RELATED APPLICATION

This application is a divisional of U.S. application Ser. No. 10/113,783, filed on Mar. 30, 2002, now abandoned, the disclosure of which is incorporated herein by reference.

BACKGROUND OF THE INVENTION

The present invention relates generally to semiconductor fabrication and, more particularly, to methods for reducing slurry usage in a linear chemical mechanical planarization (CMP) system.

In the fabrication of semiconductor devices, CMP is used to planarize globally the surface of an entire semiconductor wafer. CMP is often used to planarize dielectric layers as well as metallization layers. As is well known to those skilled in the art, in a CMP operation a wafer is rotated under pressure against a polishing pad in the presence of a slurry.

In conventional linear CMP systems, a slurry manifold, which is sometimes referred to as a slurry bar, dispenses slurry onto the polishing pad, which is in the form of a belt. In one known linear CMP system, the slurry manifold includes multiple, e.g., six, nozzles, each of which is disposed about 6 inches above the top surface of the polishing pad. In operation, each of the multiple nozzles continuously dispenses slurry droplets onto the top surface of the polishing pad.

The continuous dispensing of slurry in linear CMP systems is problematic because the slurry is relatively expensive. Indeed, it has been estimated that the cost of the slurry accounts for roughly 30% of the total cost of the consumables used in linear CMP systems. As such, any excess slurry that is used significantly increases the cost of ownership associated with linear CMP systems.

In view of the foregoing, there is a need for a method of dispensing slurry in a linear CMP system that reduces the amount of slurry used and thereby reduces the cost of ownership associated with linear CMP systems.

SUMMARY OF THE INVENTION

Broadly speaking, the present invention fills this need by providing methods for dispensing slurry in a linear chemical mechanical planarization (CMP) system in which either a pulsed flow of slurry is used, a mist of slurry is sprayed, or the gap between the nozzles and the top surface of the polishing pad is controlled.

In accordance with one aspect of the present invention, a method for dispensing slurry in a linear CMP system using a pulsed flow of slurry is provided. In this method, slurry is dispensed onto a polishing pad for a first period of time. The dispensing of slurry is then stopped for a second period of time. The dispensing and stopping operations are repeated at least once during a CMP operation. To minimize the amount of slurry used, the dispensing and stopping operations may be alternately repeated during the course of the CMP operation.

In one embodiment, the first period of time and the second period of time are substantially the same. In one embodiment, the first period of time is about 5 seconds and the second period of time is about 5 seconds. As used herein, the term "about" means that the parameter specified can be varied within an acceptable manufacturing tolerance, e.g., ±10%. In another embodiment, the first period of time is about 10 seconds and the second period of time is about 10 seconds. In yet another embodiment, the first period of time is about 20 seconds and the second period of time is about 20 seconds. In a further embodiment, the first period of time is about 10 seconds and the second period of time is about 20 seconds.

In accordance with another aspect of the present invention, a method for dispensing slurry in a linear CMP system that uses a mist of slurry is provided. In this method, a mist of slurry is sprayed onto a polishing pad. In one embodiment, the mist of slurry is generated by flowing slurry through a plurality of nozzles in the presence of a pressurizing agent. By way of example, the pressurizing agent may be a gas such as nitrogen, helium, and argon. In one embodiment, the plurality of nozzles is disposed on a showerhead.

In accordance with yet another aspect of the present invention, a method for dispensing slurry in a linear CMP system that involves controlling the gap between the nozzles and the top surface of the polishing pad is provided. In this method, a slurry manifold with multiple nozzles is oriented at an angle relative to the edge of the polishing pad. Droplets of slurry are dispensed from the nozzles such that each droplet of slurry contacts the top surface of the polishing pad before leaving the nozzle.

In one embodiment, the distance the nozzles are disposed above the top surface of the polishing pad is in the range from about 1 mm to about 2 mm. In one embodiment, the slurry manifold is oriented at an angle in the range from about 30 degrees to about 60 degrees, and preferably about 45 degrees, relative to the edge of the polishing pad.

Each of the methods for dispensing slurry in a linear CMP system summarized above reduces the amount of slurry used during a CMP operation. As the cost of slurry accounts for a significant percentage of the total cost of consumables used in linear CMP systems, reducing the amount of slurry used during a CMP operation significantly reduces the cost of ownership associated with linear CMP systems.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE INVENTION

Several exemplary embodiments of the invention will now be described in detail with reference to the accompanying drawings.

The present invention provides a number of methods for dispensing slurry in a linear chemical mechanical planarization (CMP) system. Each of these methods reduces the amount of slurry used during a CMP operation. One method involves the use of a pulsing flow of slurry instead of a continuous flow of slurry. Another method involves spraying a mist of slurry onto the polishing pad. Yet another method involves controlling the gap between the nozzles from which the slurry is dispensed and the top surface of the polishing pad. Each of these methods is described in more detail in the following discussion.

Figure 1:
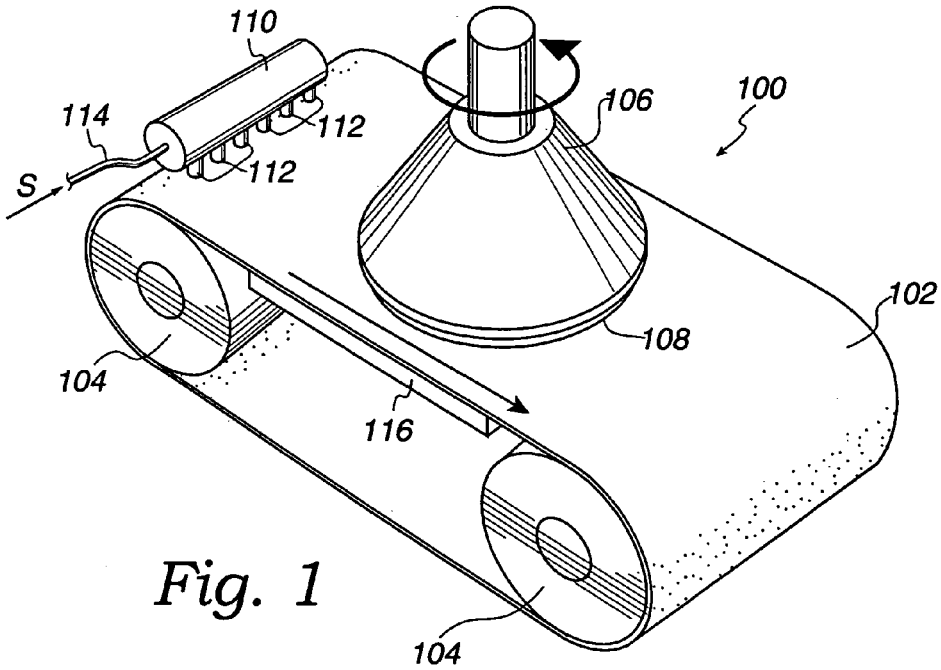
FIG. 1 is a simplified perspective view of a linear chemical mechanical planarization (CMP) system that may be used to dispense a pulsed flow of slurry in accordance with one embodiment of the invention.

FIG. 1 is a simplified perspective view of linear CMP system 100 that may be used to dispense a pulsed flow of slurry in accordance with one embodiment of the invention. As shown therein, CMP system 100 includes polishing pad 102, which is in the form of a belt that is disposed around rotating drums 104. Polishing head 106 is disposed above the top surface of polishing pad 102 and is configured to hold semiconductor wafer 108 in place during processing. Slurry manifold 110 (sometimes referred to as a slurry bar) dispenses slurry onto the top surface of polishing pad 102 through nozzles 112. Slurry is delivered to slurry manifold 110 via supply conduit 114, which is in flow communication with a source of slurry (see the arrow labeled S in FIG. 1).

As polishing pad 102 moves (e.g., in the direction of the straight arrow shown in FIG. 1), polishing head 106 rotates (e.g., in the direction of the curved arrow shown in FIG. 1) and lowers wafer 108 onto the top surface of the polishing pad. Platen assembly 116 supports polishing pad 102 during the CMP operation. Those skilled in the art are familiar with the details and operation of linear CMP systems. By way of example, some of the foregoing components, namely polishing pad 102, drums 104, polishing head 106, and platen assembly 116, may be the same as used in the TERES™ CMP system, which is commercially available from Lam Research Corporation of Fremont, Calif. (the assignee of this application). Slurry manifold 110, however, must be modified from that used in the TERES™ CMP system so that the slurry manifold is capable of dispensing a pulsed flow of slurry through nozzles 112. By way of example, slurry manifold 110 may be equipped with suitable valves and suitable timing control circuitry for turning the flow of slurry on and off.

The flow of slurry may be pulsed by alternately turning the flow of slurry on and off. By way of example, the flow of slurry may be turned off by closing one or more of the valves provided in slurry manifold 110. Thereafter, the flow of slurry may be turned on by opening one or more of the valves provided in slurry manifold 110. The opening and closing of the valve or valves may be controlled using control signals generated by the timing control circuitry.

To minimize the amount of slurry used in a CMP operation, the period of time for which the slurry is turned off should be as long as possible. On the other hand, to minimize the risk of the slurry drying in or on the nozzle and forming flakes, which can become entrained in the slurry and damage the wafer, the period of time for which the slurry is turned off should be as short as possible. In addition, the amount of slurry dispensed must be within the process window for the CMP operation. Consequently, the duty cycle for the dispensing of the slurry should be selected to balance these competing factors.

In one embodiment, the flow of slurry is alternately pulsed on and off in 5 second intervals during a CMP operation. In another embodiment, the flow of slurry is alternately pulsed on and off in 10 second intervals during a CMP operation. In a further embodiment, the flow of slurry is alternately pulsed on and off in 20 second intervals during a CMP operation. In yet another embodiment, the flow of slurry is alternately turned on for about 10 seconds and then turned off for about 20 seconds.

In preliminary tests conducted to date, only a slight decrease in removal rate was observed when the slurry flow was pulsed in a 50% on/50% off manner, e.g., 5 seconds on (at a flow rate of 200 ml/min) and 5 seconds off. Surprisingly, this slight decrease in removal rate was smaller than the decrease in removal rate observed when a continuous slurry flow was reduced from 200 m/min to 100 ml/min. In addition, almost no change in the within-wafer nonuniformity relative to wafers subjected to a CMP operation using a continuous slurry flow was observed for wafers subjected to a CMP operation in which the slurry flow was pulsed in a 50% on/50% off manner.

By pulsing the slurry on and off, the amount of slurry used during a CMP operation may be significantly reduced relative to the amount of slurry used during a CMP operation conducted using a continuous slurry flow. For example, when the duty cycle for the dispensing of slurry is 50%, i.e., the slurry is pulsed in a 50% on/50% off manner, a 50% reduction in the amount of slurry used is obtained. It will be apparent to those skilled in the art that greater reductions in the amount of slurry used in a CMP operation may be obtained by further reducing the duty cycle for the dispensing of the slurry. As noted above, however, the duty cycle should not be reduced to the point that either significant drying of the slurry occurs or the amount of slurry dispensed does not fall within the process window for the CMP operation. As noted above, dried slurry flakes are prone to cause defects and scratches on wafers being processed.

Those skilled in the art will appreciate that the pulsing of the flow of slurry may have an adverse impact on the stability of the flow rate of the slurry. The reason for this is that it takes time for the flow rate of the slurry to stabilize at the desired flow rate, e.g., 200 ml/min, each time the slurry is turned on. Any instability of the flow rate of the slurry when the slurry is turned on may affect the removal rate and cause inconsistent planarization results. If the same instability of the flow rate occurs each time the slurry is turned on, however, then it is believed that consistent planarization should be obtained. The reason for this belief is that any change in the removal rate that may occur when the slurry is turned on will be the same each time the slurry is turned on. Consequently, the impact of any change in the removal rate should be experienced uniformly throughout the CMP operation.

Figure 2:
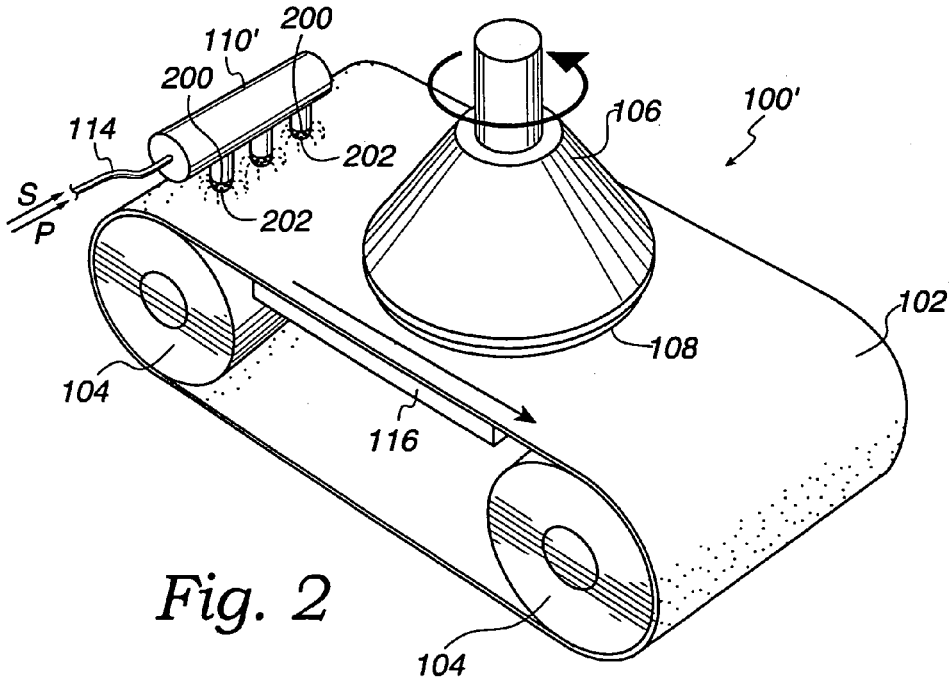
FIG. 2 is a simplified perspective view of linear CMP system that may be used to spray a mist of slurry in accordance with one embodiment of the invention.

FIG. 2 is a simplified perspective view of linear CMP system 100' that may be used to spray a mist of slurry in accordance with one embodiment of the invention. As used in connection with the description of the invention, the phrase "spray a mist of slurry" refers to the discharge of fine droplets of slurry into the air, where the droplets of slurry are finer, i.e., smaller, than those discharged from conventional slurry dispensers, e.g., a single nozzle or a slurry manifold having multiple nozzles. Linear CMP system 100' shown in FIG. 2 is the same as linear CMP system 100 shown in FIG. 1, except that slurry manifold 110' has been modified to spray a mist of slurry. In particular, as shown in FIG. 2, slurry manifold 110' includes three showerheads 200 having a plurality of nozzles 202. In addition, slurry manifold 110' is coupled in flow communication with a suitable pressurizing agent and the pressurizing agent is supplied to the slurry manifold as indicated by the arrow labeled P in FIG. 2. The pressurizing agent may be a gas that does not react significantly with the slurry, e.g., nitrogen, helium, and argon.

Figure 3:
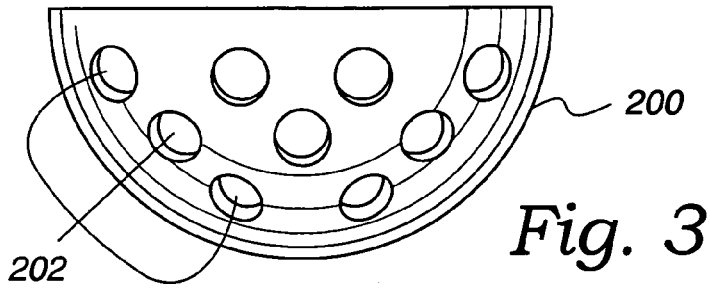
FIG. 3 is an enlarged view of the showerhead shown in FIG. 2.
Figure 4:
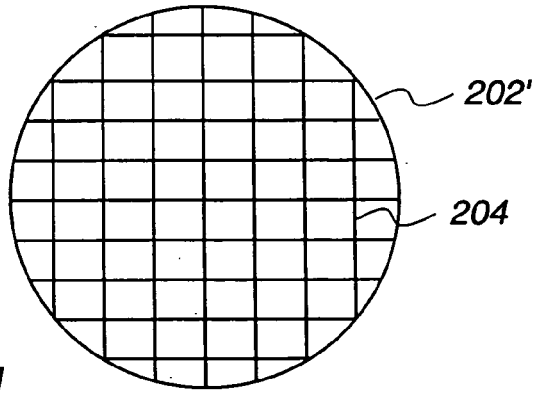
FIG. 4 is a simplified view of a nozzle that is provided with a wire mesh.

FIG. 3 is an enlarged view of showerhead 200 shown in FIG. 2. As shown in FIG. 3, showerhead 200 has a hemispherical configuration and includes a plurality of nozzles 202, which are uniformly arranged on the showerhead. The shape of showerhead 200 and the arrangement of nozzles 202 may be varied from that shown in FIG. 3 to provide a desired mist of slurry. For example, the showerhead may have a partially hemispherical configuration. To ensure that the slurry is dispersed into fine droplets, in one embodiment, the diameter of each nozzle 202 is smaller than the diameter of the nozzle used in conventional slurry dispensers. If desired, a wire mesh may be provided in the nozzle to disperse the slurry. FIG. 4 is a simplified view of nozzle 202' that is provided with wire mesh 204.

As shown in FIG. 2, the mist of slurry sprayed from each showerhead 200 spreads out and defines a footprint that is larger than the size of the showerhead because of the pressure provided by the pressurizing agent and the configuration of the showerheads. Consequently, the polishing pad can be covered with slurry using four or fewer showerheads, whereas conventional slurry manifolds typically include six nozzles. Slurry manifold 110' shown in FIG. 2 includes three showerheads 200, but it will be apparent to those skilled in the art that the number of showerheads may be increased or decreased to suit the needs of particular applications. The pressure added by the pressurizing agent advantageously enables a lower amount of slurry to be used during a CMP operation. One potential drawback of spraying a mist of slurry is that the slurry may dry in or on the showerhead and the nozzles during periods when slurry is not being sprayed. This may cause the nozzles to become clogged and may cause undesirable flakes to become entrained in the slurry. To avoid these potential problems, it may be necessary to clean the showerhead and nozzles each time the spraying of slurry is stopped for a significant period of time.

Figure 5:
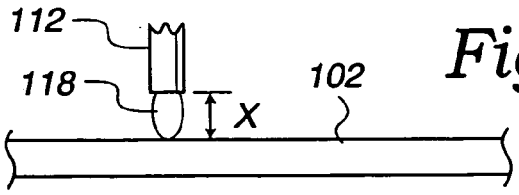
FIG. 5 is a simplified schematic diagram that shows a droplet of slurry being dispensed from a nozzle such that the droplet of slurry contacts a polishing pad before leaving the nozzle in accordance with one embodiment of the invention.

FIG. 5 is a simplified schematic diagram that shows a droplet of slurry being dispensed from a nozzle such that the droplet of slurry contacts a polishing pad before leaving the nozzle in accordance with one embodiment of the invention. As shown in FIG. 5, nozzle 112 is disposed a distance, X, above the top surface of polishing pad 102. Slurry droplet 118 is in contact with both nozzle 112 and the top surface of polishing pad 102. The distance, X, is controlled so that each droplet of slurry that flows from nozzle 112 will contact the top surface of polishing pad 102 before leaving the nozzle. In one embodiment, the distance, X, is in the range from about 1 mm to about 2 mm. It is believed that dispensing the slurry such that each droplet of slurry contacts the top surface of the polishing pad before leaving the nozzle will significantly increase the rate at which the slurry spreads out over the top surface of the polishing pad. To maximize the area over which the slurry spreads, a slurry manifold with multiple, i.e., two or more, nozzles may be oriented at an angle relative to the edge of the polishing pad, as described with reference to FIG. 6.

The small gap between the nozzles of the slurry manifold and the top surface of the polishing pad may not leave sufficient room to change the polishing pad. Thus, it will be apparent to those skilled in the art that accommodations must be made to allow the polishing pad to be changed in an efficient manner. By way of example, the slurry manifold may be adjustably mounted so that the slurry manifold can be moved to provide room to change the polishing pad.

Figure 6:
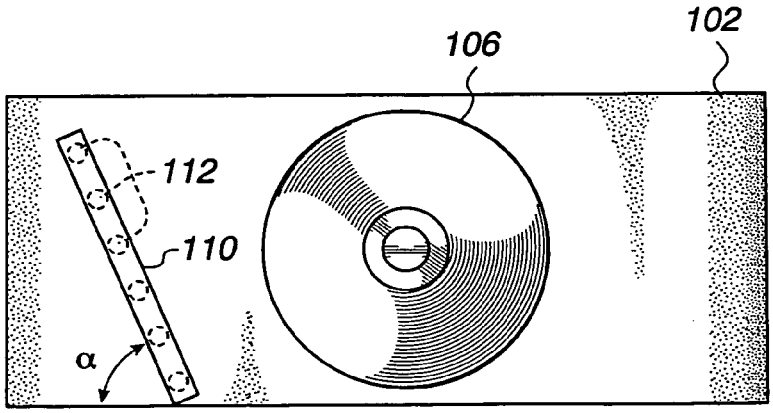
FIG. 6 is a simplified top plan view of a linear CMP system that illustrates how the slurry manifold is oriented relative to the edge of the polishing pad in accordance with one embodiment of the invention.

FIG. 6 is a top plan view of a linear CMP system that illustrates how the slurry manifold is oriented relative to the edge of the polishing pad in accordance with one embodiment of the invention. The linear CMP system shown in FIG. 6 is configured such that the slurry manifold is oriented an angle relative to the edge of the polishing pad and the gap between the nozzles and the top surface of the polishing pad is such that each droplet of slurry contacts the top surface of the polishing pad before leaving the nozzle. By way of example, linear CMP system 100 shown in FIG. 1 may be modified to have such configuration. As shown in FIG. 6, slurry manifold 110, which includes nozzles 112, is oriented at an angle, $\alpha$, relative to the edge of polishing pad. In one embodiment, the angle, $\alpha$, is in the range from about 30 degrees to about 60 degrees. Within this range, the likely optimum in terms of slurry spreading is about 45 degrees.

As described above, it is believed that the rate at which the slurry spreads out over the top surface of the polishing pad can be significantly increased by 1) controlling the gap between the nozzles and the top surface of the polishing pad, and 2) orienting the slurry manifold at an angle relative to the edge of the polishing pad. As a result, less slurry can be used during a CMP operation without falling outside the process window for the CMP operation.

Each of the methods for dispensing slurry in a linear CMP system described herein reduces the amount of slurry used during a CMP operation. As the cost of slurry accounts for a significant percentage of the total cost of consumables used in linear CMP systems, reducing the amount of slurry used during a CMP operation significantly reduces the cost of ownership associated with linear CMP systems.

In summary, the present invention provides a number of methods for dispensing slurry in a linear CMP system, including pulsing the flow of slurry, spraying a mist of slurry, and controlling the gap between the nozzles from which the slurry is dispensed and the top surface of the polishing pad. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. In a linear chemical mechanical planarization system, a method for dispensing slurry, comprising:

spraying a mist of slurry onto a polishing pad, wherein the mist of slurry is generated by flowing slurry through a plurality of nozzles in the presence of a pressurizing agent comprising a gas selected from the group consisting of nitrogen, helium, and argon.

2. The method of claim 1, wherein the plurality of nozzles is disposed on a showerhead.

3. In a chemical mechanical planarization system, a method for dispensing slurry, comprising:

(a) spraying a mist of slurry onto a polishing pad for a first period of time;

(b) stopping the spraying of the mist of slurry for a second period of time; and (c) repeating operations (a) and (b) at least once during a CMP operation.

4. The method of claim 3, wherein the first period of time and the second period of time are substantially the same.

5. The method of claim 3, wherein the first period of time is about 5 seconds and the second period of time is about 5 seconds.

6. The method of claim 3, wherein the first period of time is about 10 seconds and the second period of time is about 10 seconds.

7. The method of claim 3, wherein the first period of time is about 20 seconds and the second period of time is about 20 seconds.

8. The method of claim 3, wherein the first period of time is about 10 seconds and the second period of time is about 20 seconds.

9. The method of claim 3, wherein operations (a) and (b) are alternately repeated during a CMP operation.

10. A chemical mechanical planarization system, comprising:

a polishing pad; and a slurry manifold including at least one showerhead having a plurality of nozzles configured to spray a mist of slurry onto a top surface of the polishing pad, wherein the slurry manifold is coupled in flow communication with a pressurizing agent comprising a gas selected from the group consisting of nitrogen, helium, and argon.

* * * * *